US005474342A

United States Patent [19]

Smith et al.

[11] Patent Number: 5,474,342

[45] Date of Patent: Dec. 12, 1995

[54] DOOR LATCH ACTUATOR

[76] Inventors: Jerry R. Smith, 5690 W. Rowland Ave., Littleton, Colo. 80123; John N. Hick, 1093 Geneva St., Aurora, Colo. 80010

[21] Appl. No.: 101,851

[22] Filed: Aug. 4, 1993

[51] Int. Cl.[6] ..... E05B 15/00

[52] U.S. Cl. ..... 292/254; 292/341.16

[58] Field of Search ..... 292/254, 341.16, 292/341.17, 201

[56] References Cited

U.S. PATENT DOCUMENTS

| | | | |
|---|---|---|---|
| 277,628 | 5/1883 | Sullivan | 292/341.16 |
| 322,681 | 7/1885 | Casey | 292/341.16 |
| 3,521,921 | 7/1970 | Miyazaki | 292/254 X |
| 3,774,422 | 11/1973 | Hogan et al. | 292/341.16 X |
| 4,073,518 | 2/1978 | Goodwin . | |
| 4,212,489 | 7/1980 | Snyder . | |
| 4,679,834 | 7/1987 | Gotanda | 292/254 X |
| 4,929,003 | 5/1990 | McConnell . | |
| 4,984,835 | 1/1991 | Vadacchino et al. . | |
| 5,029,912 | 7/1991 | Gotanda . | |
| 5,076,625 | 12/1991 | Oxley . | |
| 5,083,448 | 1/1992 | Karkkainen et al. . | |
| 5,100,184 | 3/1992 | Schmitt . | |
| 5,100,186 | 3/1992 | Nordvall . | |

*Primary Examiner*—Rodney M. Lindsey
*Attorney, Agent, or Firm*—Timothy J. Martin

[57] ABSTRACT

A door latch actuator is adapted for use in association with a bolt receiver which is to be engaged by a latch bolt of latch bolt assembly on a door mounted for movement between a first door position and a second door position. The latch bolt assembly includes a latch bolt having a distal end which slideably moves between an extended state and a retracted state. In the extended state, the latch bolt assembly is operative to engage a bolt receiver to retain the door at the first door position in a secured condition. Broadly, the door latch actuator comprises an actuator element and a driver. The actuator element is disposed in proximity to the distal end of the latch bolt when the door is at the first door position in the secured condition and moves between a first actuator position and a second actuator position. In the first actuator position, the actuator element allows the distal end of the spring latch bolt to engage a bolt receiver in the extended state. When moved into the second actuator position, the actuator element displaces the spring latch bolt from the extended state to the retracted state causing the door to be in an unsecured condition at the first door position so that the door can be moved from the first door position to the second door position.

21 Claims, 4 Drawing Sheets

DOOR LATCH ACTUATOR

FIELD OF THE INVENTION

This invention generally relates to security devices for doors to control access by personnel into buildings or restricted areas therein. More particularly, this invention relates to a door latch actuator which works in cooperation with a standard latch bolt assembly of a door. This invention is specifically suitable to retro-fit on existing doors and can be used in conjunction with electronic door security systems which afford access to those who employ a valid card key device or an authorized code.

BACKGROUND OF THE INVENTION

Providing security for a door has been a concern over centuries. The earliest known mechanical lock for a door can be traced back to early Egyptian times over 4,000 years ago. The early Egyptians employed a sliding wooden bolt through a stationary staple. The staple contained vertically positioned pin tumblers which extended into corresponding holes in the bolt when locked. The key was a curved, flattened wooden stick with pins projecting from one end. This end of the key was inserted into a hollowed portion of the bolt and maneuvered upwardly to push the pins from the bolt. The bolt then could be withdrawn to unlatch the door.

By the 13th Century, a metal warded lock which was first developed by the Romans, became very popular throughout Europe. This type of lock required that a key must be made to bypass the wards of the lock. Once bypassed, the key could then be turned to operate the latch. During the 18th Century, the tumbler lock was invented. Similar to the principal of the early Egyptian lock, the tumbler could be raised an exact height to clear its slot. This lock remains as the basis for modern locks today with the only difference being the use of multiple tumblers. Although lock and keys are still an effective way of controlling access to a building structure or a restricted area therein, the issuance of a key or a set of keys to numerous personnel has become impractical.

In general, modern door locks are used in conjunction with a conventional latch bolt assembly which is installed on a standard door. The latch bolt assembly includes a spring latch bolt and often includes a dead latch bolt that enables and disables movement of the spring latch bolt. The spring latch bolt is spring biased to extend from the door and into a latch bolt receiving cavity in the doorjamb when the door is in a closed position. The dead latch both is spring-biased outwardly from the latch assembly, but, when the door is secured, the dead latch bolt is depressed to disable retraction of the spring latch bolt. The spring latch bolt is slideably movable between an extended state and a retracted state and the dead latch bolt is slideably movable between an enable state and a disable state. In the enable state, the dead latch bolt permits the spring latch bolt to move from the extended state to the retracted state. In the disable state, the dead latch bolt prohibits the spring latch bolt from moving from the extended state to the retracted state. Typically, a strike plate is used to retain the dead latch bolt in its disable state unless a computerized security system is employed.

When security is required to control access through a door, especially one that is provided with the standard latch assembly described above, it is known to employ a computerized security system. Here, anyone with a valid key card or an authorized access code can gain access through secured doors. With the advent of computers, each person can have his/her own key card or access code so that a person may be authorized to gain access through one, all or a specified number of doors. If, for example, the key card is lost or stolen, that particular key card could be canceled and a new key card with a new access code could be issued.

In a computerized system, an electronic strike is activated when the appropriate access code is detected so that the person having a valid key card may enter through the door. In general, this electronic strike includes a single-lobed cam that pivots between a door lock position and a door release position. In its door lock position, the cam is positioned to simultaneously capture the spring latch bolt and the dead latch bolt with the spring latch bolt projecting into its extended state and and with the dead latch bolt retained in its disable state. In the door lock position, a pin from an electrically-powered solenoid extends into a recess in the cam to prevent movement of the cam from pivoting out of its door lock position. When the correct access code is detected, the pin from the solenoid withdraws from the recess in the cam so that the cam is free to pivot away from the latch as the door is pulled open. After the latch bolt assembly clears the cam, it springs back into its original position and, after a few seconds, the pin of the solenoid once again is extended into the recess of the cam to retain the door in its closed position.

A problem associated with this solenoid-type electric strike is that, if a user is pulling on the door at that time when the computer sends the electric signal to release the strike, the strike might not release. Pulling on a door results in pulling on the extended latch. The extended latch, in turn, applies back pressure against the cam being held by the solenoid pin in the door lock position. Now, the solenoid pin is unable to be withdrawn from its recess due to this back pressure. Thus, the pin cannot release thereby preventing the door from being opened.

Furthermore, installation of such a strike device for an existing, unsecured door requires substantial modifications to the doorjamb. Not only must the side portion of the doorjamb be modified but also the front portion of the doorjamb must be modified. This results in the electric strike being exposed so that now an intruder may use a lever against the cam to break the solenoid pin of the door latch actuator for easy entry because there is no face plate or other protective mechanism to encase the electric strike.

A need exists in the marketplace to provide a door latch actuator that is easy to install into existing doorjambs without making major modifications thereto. It would be beneficial if the door latch actuator is simple and inexpensive to manufacture. There is also a need to provide a door latch actuator that can provide a higher measure of security to prevent easy breaking and entering as compared to existing electric strike devices. It would be advantageous to provide a door latch actuator that can employ conventional components such as the strike plate that is presently being used on the doorjamb. The major benefit of using prior art components is that non-secured doors can now be easily retro-fitted as secured doors. Also, reducing installation time of the door latch actuator would be beneficial. It is from these considerations and others that the present invention has evolved.

SUMMARY OF THE PRESENT INVENTION

It is an object of the present invention to provide a new and useful door latch actuator that is simple to manufacture and easy to install.

It is yet another object of the present invention to provide a door latch actuator that is generally insensitive to back pressure applied to the door so that the door can be opened even if back pressure is being applied to the door.

It is yet a further object of the present invention to provide a door latch actuator that provides a higher degree of security, compared to those of the prior art, by employing a strike plate which is commonly used on door jambs.

A still further object of the present invention is to provide a door latch actuator whereby its installation time is brief and its installation cost is inexpensive.

Another object of the present invention is to provide a door latch actuator that can be easily retrofitted onto existing non-secured door systems to provide security therefor without making major modifications to the doorjamb.

Yet another object of the present invention is to provide a door latch actuator that interacts with the standard dead latch bolt to depress the dead latch bolt until actuation so that the security feature afforded by the dead latch bolt is retained.

In general, the door latch actuator of the present invention is adapted for use in association with a conventional latch bolt assembly on a conventional door which is pivotally mounted on a door frame for movement between a first door position and a second door position. The latch bolt assembly includes a latch bolt having a distal end which slideably moves between an extended state and a retracted state and is operative in the extended state to engage a bolt receiver to retain the door at the first door position in a secured condition. In its broadest form, the door latch actuator comprises an actuator element which is disposed in proximity to the distal end of the latch bolt when the door is at the first door position in the secured condition and a driver which is associated with the actuator element. The actuator element moves between a first actuator position and a second actuator position. In the first actuator position, the actuator element allows the distal end of the latch bolt to engage the bolt receiver in the extended state. In the second actuator position, the actuator element mechanically displaces the latch bolt from the extended state to retracted state causing the door to be in an unsecured condition at the first door position so that the door can then be moved from the first door position to the second door position. The driver operates to move the actuator element between the first and second actuator positions.

The actuator member preferably is a cam, and the driver acts to move the cam between the first and second actuator positions. The cam provides a first cam surface operative to contact the distal end of the latch bolt in order to move the latch bolt from the extended state to the retracted state when the driver moves the cam between the first and second actuator positions. The driver operates to provide a reversible driving force to the cam and acts to reciprocally pivot the cam between the first and second actuator positions. It is preferred that the driver includes an electric motor and a gear assembly operably connected to and between the electric motor and the cam. It is also preferred that the door latch actuator include a controller device operative to reversibly activate the driver so that the cam is caused to pivot between the first and second actuator positions. Also, timer circuitry may be included with the controller to operate after the cam pivots from the first actuator position to the second actuator position to cause the cam to return the first actuator position upon expiration of a selected period of time.

Where the conventional latch bolt assembly in the door includes a spring latch bolt and dead latch bolt, an alternative door latch actuator can be employed according to the present invention. Here, the latch bolt assembly is mounted on a door that is pivotally mounted in a door frame for movement between a first door position and a second door position. The alternative door latch actuator is then mounted a latch bolt receiving cavity in a doorjamb. Generally, the door latch actuator comprises an actuator element disposed in proximity to distal ends of the spring latch bolt and the dead latch bolt and a driver which is associated with the actuator element. The actuator element moves between a first actuator position and a second actuator position. In the first actuator position, the actuator element is operative to retain the dead latch bolt in the disable state while allowing the spring latch bolt to extend into the latch bolt receiving cavity in the extended state to retain the door at the first door position in a secured condition. The actuator element, operative upon movement from the first actuator position to the second actuator position, first releases the dead latch bolt so that it moves into the enable state, the actuator element next attacks the distal end of the spring latch bolt to move the spring latch bolt from the extended state to the retracted state. Now, the door can be moved from the first door position to the second door position. The driver operates to move the actuator element between the first and second actuator positions by causing the actuator element to pivot about an axis.

The actuator element includes a first actuator cam portion and a second actuator cam portion connected to the first actuator cam portion. The first actuator cam portion has a first cam surface which operates to contact the distal end of the dead latch bolt when the actuator is in the first actuator position. The second actuator cam portion has a second cam surface which operates to contact the distal end of the spring latch bolt when the actuator is in the second actuator position.

The driver includes an electric motor and a gear assembly. The gear assembly is operatively connected to and between the electric motor and the actuator element. It is preferable that the door latch actuator include a controller device which operates to reversibly activate the driver so that the actuator element reciprocates between the first and second actuator positions. Furthermore, the controller device preferably includes timer circuitry which would operate after the actuator element pivots from the first actuator position to the second actuator position to cause the actuator element to return to the first actuator position upon expiration of selected period of time. The door latch actuator also includes a strike plate which is adapted to connect to the driver and to releasably attach to the doorjamb and over the latch bolt receiving cavity. The strike plate has a port adapted for the spring latch bolt and the dead latch bolt to extend therethrough and into the latch bolt receiving cavity in the doorjamb. Also, the door latch actuator includes a support bracket which is attached to the strike plate and adapted to secure the driver to the strike plate. A support element also attaches to the strike plate and is adapted to pivotally receive the actuator element. The support element preferably includes a stop portion which is adapted to restrict movement of the actuator element between the first and second actuator positions.

Another alternative embodiment of the present invention can be fabricated by modifying the strike plate and the actuator element. The strike plate would include a pair of support prongs and a link plate. The support prongs are adapted to pivotally receive the actuator element. The actuator element would include an actuator cam portion pivotally connected to a sliding link. Upon movement from the first actuator position to the second actuator position, the sliding link, being operative to slide along the vertical surface, first allows the dead latch bolt to move from the disable state to the enable state so that the actuator cam portion can then attack the distal end of the spring latch bolt to move it from the extended state to the retracted state. A spring connected to the actuator cam and the sliding link operates to bias the sliding link against the vertical surface.

Other embodiments of the present invention include a pair of solenoids, a pair of actuator pieces or a combination of a solenoid and an actuator piece.

These and other objects of the present invention will become more readily appreciated and understood from a consideration of the following detailed description of the preferred exemplary embodiments when taken together with the accompanying drawings, in which:

BRIEF DESCRIPTION OF THE DRAWINGS

FIG. 5(*b*) is a top plan view taken along line 5—5 in FIG. 4 of the actuator element of the present invention disposed in proximity to the conventional latch bolt assembly wherein the spring latch bolt extends into the latch bolt receiving cavity in the extended state and the dead latch bolt is released to the enable state;

FIG. 5(*c*) is a top plan view taken along line 5—5 in FIG. 4 of the actuator element of the present invention disposed in proximity to the conventional latch bolt assembly wherein the spring latch bolt is retained in the retracted state;

FIG. 7(*b*) is a top plan view of the actuator element disposed in proximity to the conventional latch bolt assembly of FIG. 6 wherein the spring latch bolt is retained within the latch bolt receiving cavity in the retracted state;

FIG. 9(*b*) is a top planar view of the actuator element of FIG. 8 disposed in proximity to the conventional latch bolt assembly wherein the sliding link slides along a vertical surface to first allow the dead latch bolt to move to the enable state and an actuator cam portion attacks the spring latch bolt extending into the latch bolt receiving cavity;

FIG. 9(*c*) is a top plan view of the actuator element of FIG. 8 disposed in proximity to the conventional latch bolt assembly wherein the actuator cam portion retains the spring latch bolt in the retracted state within the latch bolt receiving cavity;

DESCRIPTION OF THE EXEMPLARY EMBODIMENTS

A door latch actuator of the present invention is adapted to be installed into a latch bolt receiving cavity formed in a doorjamb so that it can operate with a conventional door latch assembly of a common door. Typically, the door latch assembly includes a spring latch bolt and a dead latch bolt. Generally, for interior doors, the door latch assembly might include only the spring latch bolt. The door latch actuator of the present invention operates with either type of door latch assembly and, in its broadest form, includes an actuator element and a driver.

Figure 1:
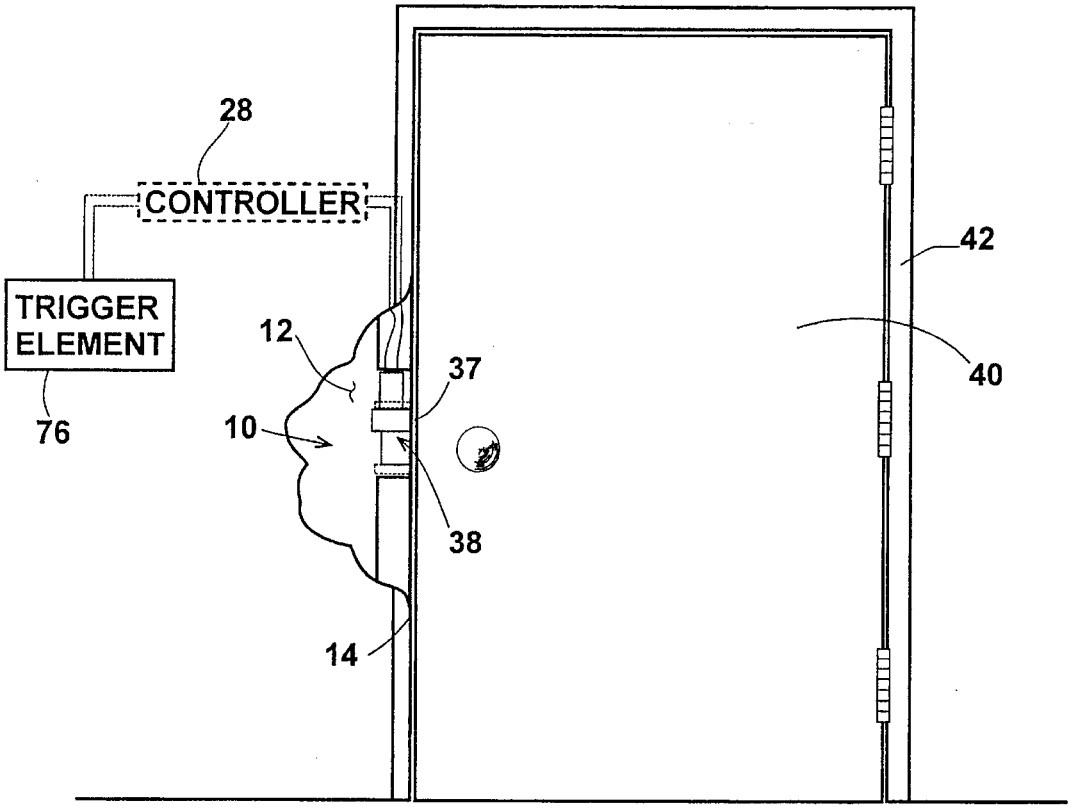
FIG. 1 is a side elevational view of a door in a secured condition at a first door position within a doorjamb and having a portion of the doorjamb broken away to show a door latch actuator according to a first preferred exemplary embodiment of the present invention and operable with a conventional latch bolt assembly of a door and a conventional electronic trigger element.
Figure 2:
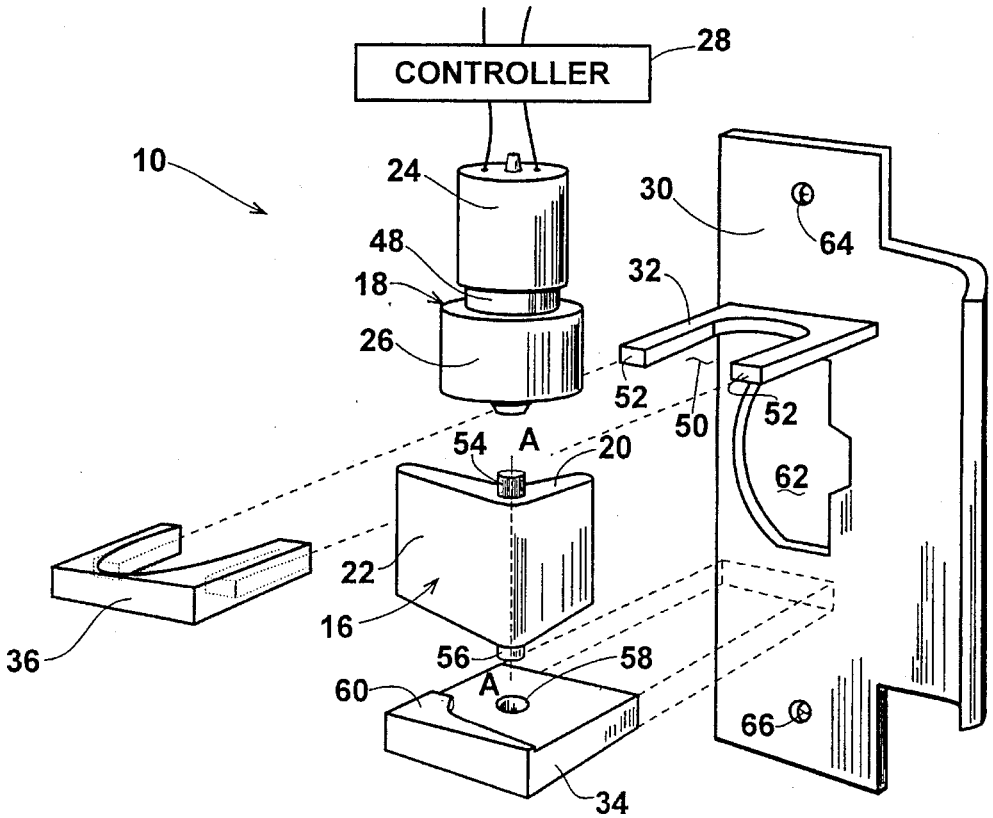
FIG. 2 is an exploded perspective view of the door latch actuator shown in FIG. 1.

With reference to FIGS. 1 through 5, a first preferred exemplary embodiment of a door latch actuator 10 of the present invention and its operation are shown. In FIG. 1, a door latch actuator 10 is shown mounted in a latch bolt receiving cavity 12 in a doorjamb 14. As best shown in FIG. 2, the door latch actuator 10 comprises an actuator element 16 and a driver 18. Here, actuator element 16 includes a first actuator cam portion 20 and a second actuator cam portion 22 which is integrally formed with one another in an L-shaped configuration. The driver 18 includes an electric motor 24 and a gear assembly 26 which is operably connected to and between the electric motor 24 and the actuator element by a shaft (not shown) of the electric motor 24 and acts to drive the actuator element 16. It is preferable that the door latch actuator 10 be operatively mounted to and supported by a strike plate 30. Accordingly, a support bracket 32 and a support element 34 are attached to the strike plate 30. A support bracket fastener 36 cooperates with the support bracket 32 in order to secure the driver 18 onto the strike plate 30. A suitable electronic controller 28 is provided to control operation of motor 24.

Figure 4:
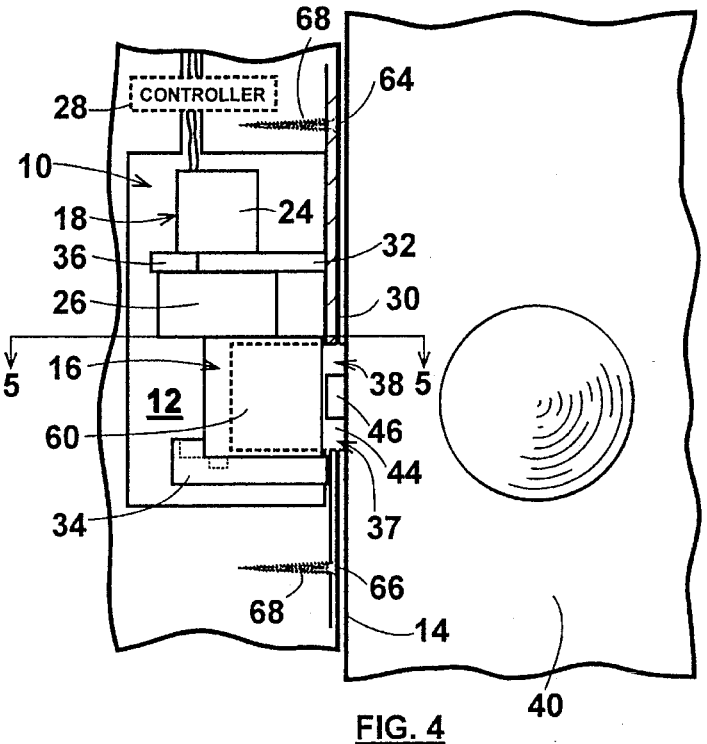
FIG. 4 is an enlarged side elevational view of the door latch actuator of FIGS. 1 and 2 and operable with the conventional latch bolt assembly shown in FIG. 3.
Figure 3:
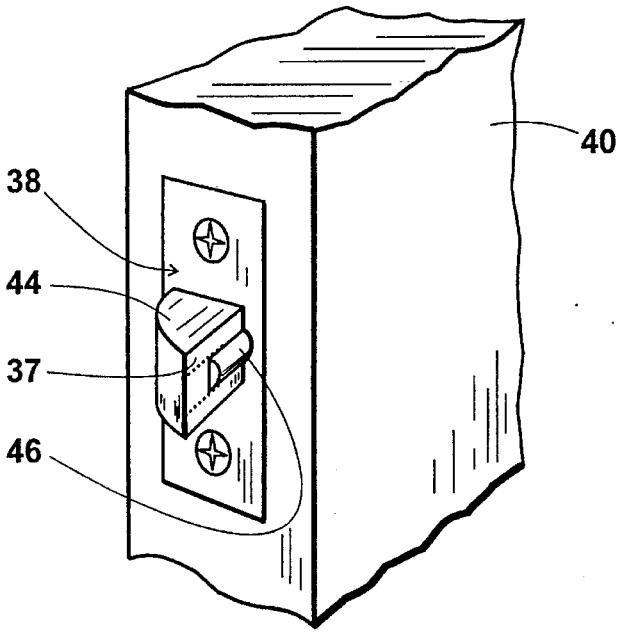
FIG. 3 (PRIOR ART)
FIG. 3 is a perspective view of the distal ends of a spring latch bolt and a dead latch bolt which extend from a conventional latch bolt assembly installed in a conventional door.

The door latch actuator 10 is mounted in a latch bolt receiving cavity in a doorjamb and works in conjunction with a conventional latch bolt assembly 38 installed on a standard door 40 as shown in FIGS. 1, 3 and 4. The door 40 is pivotally mounted in a door frame 42 (FIG. 1) so that the door can move between a first door position and a second door position. As best shown in FIG. 3, the latch bolt assembly 38 includes a spring latch bolt 44 and a dead latch bolt 46. Both the spring latch bolt 44 and the dead latch bolt 46 have distal ends respectively which are spring biased to extend into the latch bolt receiving cavity 12 in the doorjamb 14 when the door 40 is in the first door position as shown in FIGS. 1 and 4. As one of ordinary skill in the art would appreciate, the spring latch bolt 44 is slideably movable between an extended state and a retracted state and the dead latch bolt 46 is slideably movable between an enable state and a disable state. In the enable state, the dead latch bolt 46 permits the spring latch bolt 44 to move from the extended state to the retracted state. In the disable state, the dead latch bolt 46 prohibits the spring latch bolt 44 from moving from the extended state to the retracted state. As shown in FIG. 3, the spring latch bolt 44 is depicted in the extended state while the dead latch bolt 46 is depicted in its disable state. The dead latch bolt 46, shown in phantom in FIG. 3, is depicted in its enable state.

To comprehend the assembly of the door latch actuator 10, reference is made to FIGS. 2 and 4. The strike plate 30 is adapted to connect to the driver 18. An elliptical-shaped structure 48 is rigidly attached between the electric motor 24 and the gear assembly 26. The structure 48 is received by a U-shaped slot 50 formed in the support bracket 32 attached to the strike plate 30 for a nestled fit. The support bracket fastener 36 captures the remaining portion of the elliptically-shaped structure 48 while receiving a pair of prong portions 52 and 54 of the support bracket 32 to secure the driver 18 to the strike plate 30. Although one of ordinary skill in the art would appreciate that there are many mechanical methods to fasten the driver 18 to the strike plate 30, this particular mechanical method not only secures the driver 18 to the strike plate 30 but also it prevents the driver from counter-rotating within the support bracket 32 and the support bracket fastener 36 when the driver 18 is actuated.

Shown in FIG. 2, the actuator element 16 is disposed to pivot about an axis "A". A first trunnion pin 54 is concentrically positioned along axis "A" and is operably connected to the actuator element 16. Trunnion pin 54 has gear teeth and is received and driven by gear assembly 26 so that the driver 18 causes the actuator element 16 to pivot about axis "A". A second trunnion pin 56 is coaxially aligned along axis "A" and projects from the other end of actuator element 16. One of ordinary skill in the art would understand other commonly-known methods to operably connect the actuator element 16 to the driver 18.

The support element 34 is adapted to attach to the strike plate 30 by either applying an adhesive thereto or using a mechanical means such as by employing screws, rivets or other commonly known fastener means. The support element 34 is also adapted to pivotally receive the actuator element 16. The second trunnion pin 56 projecting from actuator element 16 is received by a pin-receiving hole 58 in the support element 34. The support element 34 not only helps to secure the driver 18 and the actuator member 16 to the strike plate 30 but also acts as a guide when the actuator element 16 pivots between the first and second actuator positions. For purposes of the preferred exemplary embodiment only, the support element 34 includes a stop portion 60 which is adapted to restrict movement of the actuator element 16 between the first and second actuator positions while the actuator element 16 pivots therebetween.

The strike plate 30 has a port 62 which is adapted so that the spring latch bolt bolt 44 and the dead latch bolt 46 may extend therethrough and into the latch bolt receiving cavity 12 in the doorjamb 14. Holes 64 and 66 are formed into the strike plate 30. As shown in FIG. 4, wood screws 68 are driven through holes 64 and 66 to releasably attach the strike plate 30 to the doorjamb 14 and over the latch bolt receiving cavity 12. Strike plate 30 with its port 62 acts with latch bolt receiving cavity 12 to provide a bolt receiver that receives the spring latch bolt 44. Alternatively, the bolt receiver could be provided solely by the actuator element 16.

Figure 5A:
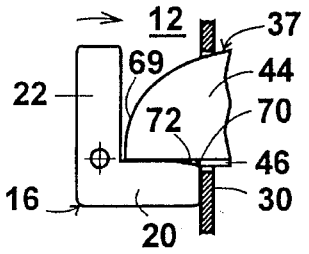
FIG. 5(*a*) is a top plan view taken along lines 5—5 in FIG. 4 of an actuator element of the present invention disposed in proximity to the conventional latch bolt assembly wherein a spring latch bolt extends into a latch bolt receiving cavity in the extended state and a dead latch bolt is retained in the disable state within the latch bolt receiving cavity.
Figure 5B:
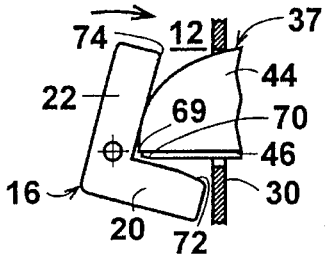
Figure 5C:
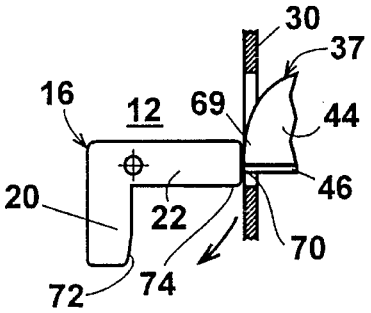

When the door latch actuator 10 is mounted in the latch bolt receiving cavity 12 in the doorjamb 14, the actuator element 16 is disposed in proximity to a distal end 69 of the spring latch bolt 44 and a distal end 70 of the dead latch bolt 46 as depicted in FIG. 5(a). The actuator element 16 is movable between a first actuator position as shown in FIG. 5(*a*) and a second actuator position as shown in FIG. 5(*c*) through an intermediate position shown in FIG. 5(*b*). When in the first position (FIG. 5(*a*)), the actuator element 16 is operative to retain the dead latch bolt 46 in the disable state while allowing the spring latch bolt 44 to extend into the latch bolt receiving cavity 12 in the extended state, thus retaining the door 40 at the first door position in a secured condition. Upon movement from the first actuator position to the second actuator position, the actuator element 16 is operative to first allow the dead latch bolt 46 to move into the enable state (FIG. 5(*b*)) so the actuator element 16 can next attack the distal end 69 of the spring latch bolt 44 to move it from the extended state to the retracted state (FIG. 5(*c*)). When the spring latch bolt 44 is in its retracted state, the door 40 is caused to be in an unsecured condition at the first door position so that the door 40 can now be moved from the first door position to the second door position. It should be appreciated that it is within the scope of this invention that the first position may be where the door is closed, or, alternatively where the door is open depending upon whether it is desired to receive the door in a closed or open position. The driver 18 which is associated with the actuator element 16 is, in any event, operative to move the actuator element 16 between the first and second actuator positions as shown in FIGS. 5(*a*) and 5(*c*), respectively.

The actuator element 16 includes the first actuator cam portion 20 and the second actuator cam portion 22 which is connected to the first actuator cam portion 20. As shown in FIGS. 5(*a*), the first actuator cam portion 20 has a first cam surface 72 which is operative to contact a distal end 70 of the dead latch bolt 46 when the actuator element 16 is in the first actuator position. The second actuator cam portion 22 has a second cam surface 74 which is operative to contact the distal end 68 of the spring latch bolt 44 when the actuator element 16 is in the second actuator position.

It is preferred that the door latch actuator 10 include the controller device 28 which is shown in FIGS. 1, 2 and 4. The controller device 28 is a standard electronic controller known in the art and is operative to reversibly activate the driver 18 so that the actuator element 16 reciprocates between the first and second actuator positions as shown by viewing FIGS. 5(*a*), 5(*b*) and 5(*c*) in sequence. It is also preferred that the controller device 28 includes timer circuitry which would be operative after the actuator element 16 pivots from the first actuator position to the second actuator position to cause the actuator element 16 to return to the first actuator position upon expiration of a selected period of time.

Figure 6:
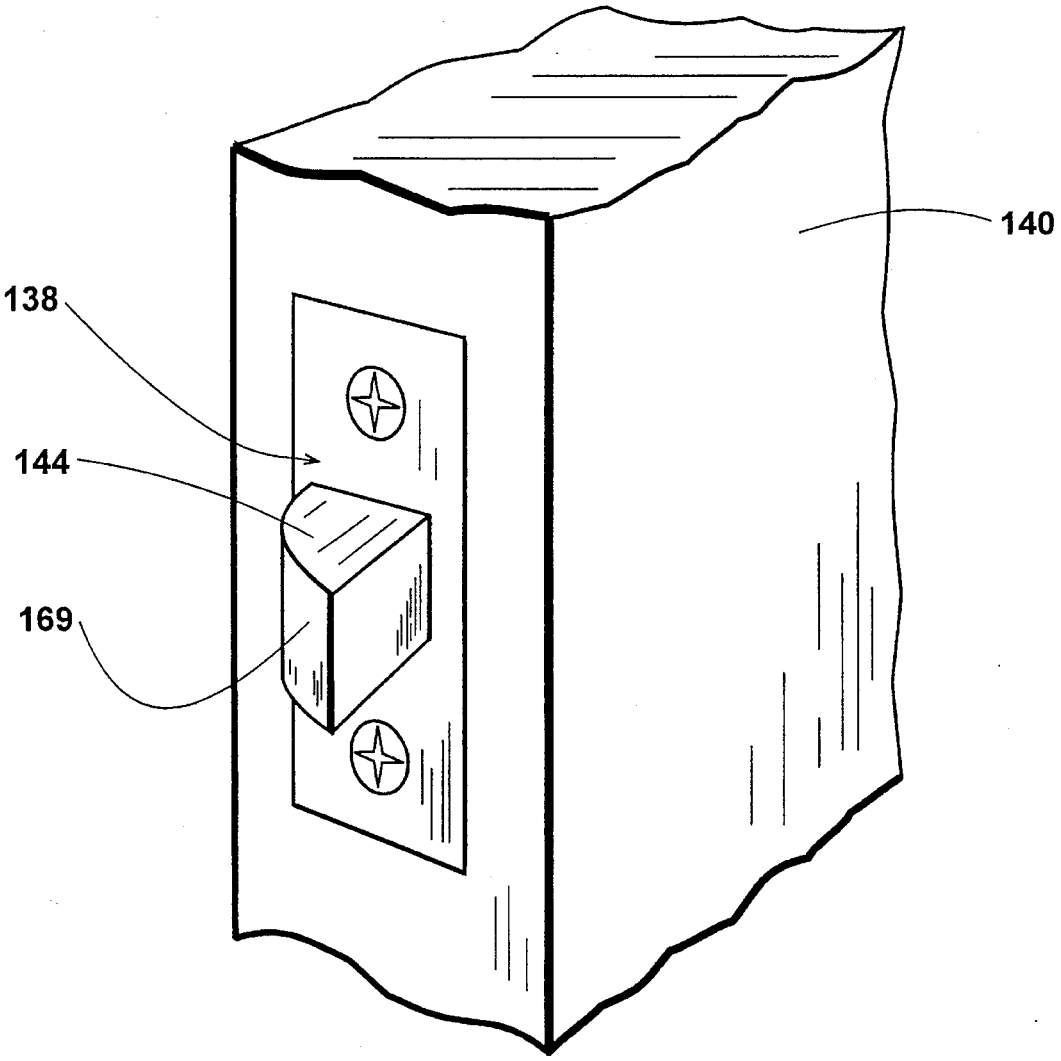
FIG. 6 (PRIOR ART)
FIG. 6 is a perspective view of the distal end of a spring latch bolt extending from a conventional latch bolt assembly but where no dead latch bolt is employed.
Figure 7A:
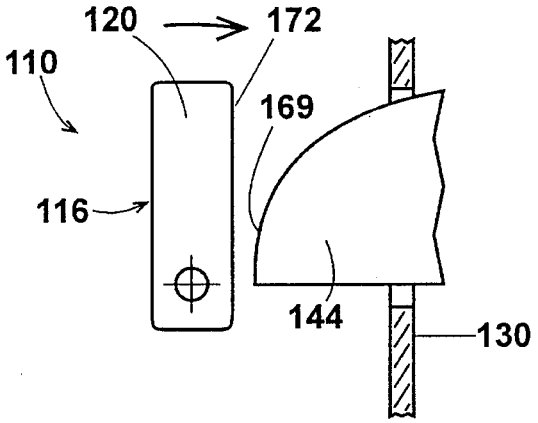
FIG. 7(*a*) is a top plan view of the actuator element disposed in proximity to the conventional latch bolt assembly of FIG. 6 wherein a spring latch bolt extends into a latch bolt receiving cavity in the extended state.
Figure 7B:
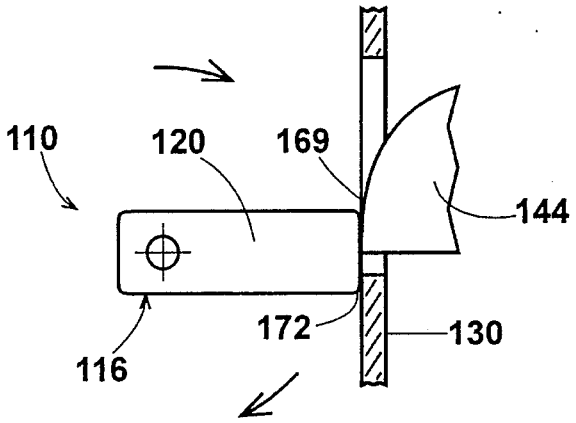

Another type of conventional latch bolt assembly 138 installed onto a conventional door 140 is shown in FIG. 6. The latch bolt assembly 138 includes a latch bolt 144 having a distal end 168 which slideably moves between an extended state as shown in FIGS. 6 and 7(*a*) and a retracted state as shown in FIG. 7(*b*). The latch bolt 144 is operative in the extended state to engage a bolt receiver 130 to retain the door 140 in a secured condition at the first door position. A first alternative exemplary embodiment of a door latch actuator 110 is adapted for use in association with the bolt receiver 130 which is to be engaged by the latch bolt 144 of the latch bolt assembly 138 on the door 140 shown in FIG. 6. The first alternative exemplary embodiment of the door latch actuator 110 includes an actuator element 116 and a driver. Since the structure of the driver and its operation were disclosed in detail hereinabove, it is deemed that no further explanation of the driver is necessary for the purpose of describing the alternative embodiments.

The actuator element 116 is disposed in proximity to the distal end 168 of the latch bolt 144 when the door is at the first door position in the secured condition. The actuator element 116 is movable between a first actuator position as shown in FIG. 7(*a*) and a second actuator position as shown in FIG. 7(*b*). In the first actuator position (FIG. 7(*a*)), the actuator element 116 allows the distal end 168 of the latch bolt 144 to engage the bolt receiver 130 in the extended state. In the second actuator position (FIG. 7(*b*)), the actuator element 116 displaces the latch bolt 144 from the extended state to the retracted state when the latch bolt 144 is in its retracted state, the door 40 is caused to be in an unsecured condition at the first door position so that now the door 40 can be moved from the first door position to the second door position. The actuator member 116 includes a cam 120. The driver acts to move the cam 120 between the first and second actuator positions. The cam 120 provides a first cam surface 172 which is operative to contact the distal end 168 of the latch bolt 144 to move the latch bolt 144 from the extend state to the retracted state when the driver moves the cam 120 between the first and second actuator positions.

Figure 8:
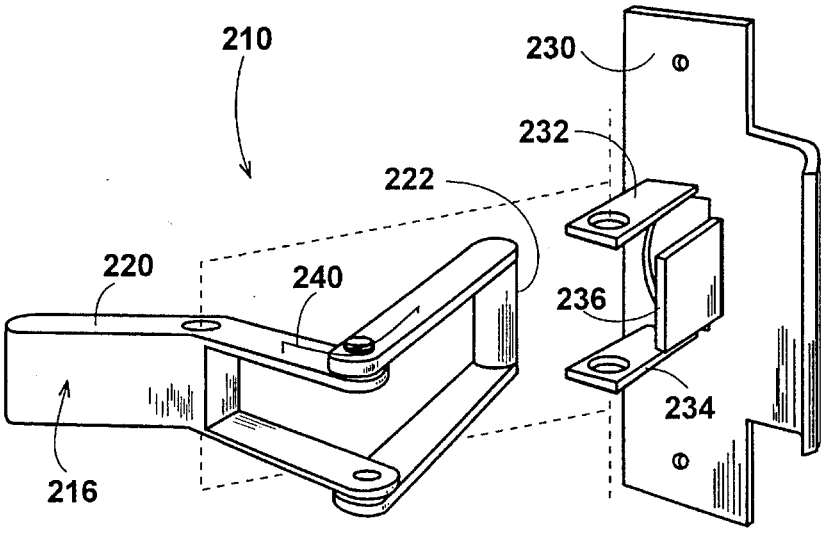
FIG. 8 is a perspective view of a second alternative exemplary embodiment of a door latch actuator shown in FIG. 2.

A second alternative exemplary embodiment of a door latch actuator 210 is shown in FIG. 8. This door latch actuator 210 is particularly adapted for use in association with the latch bolt assembly 38 which includes both a spring latch bolt 44 and a dead latch bolt 46 as shown in FIG. 3. Again, because the driver has been discussed in detail hereinabove, no further discussion of it is deemed necessary.

An actuator element 216 includes an actuator cam portion 220 which is pivotally connected to a sliding link 222. A strike plate 230 includes a pair of support prongs 232 and 234 and a link plate 236. The support prongs 232 and 234 are adapted to pivotally receive the actuator cam portion 220. The link plate 236 is adapted to provide a vertical surface 238 upon which the sliding link 222 can slide as shown sequentially in FIGS. 9(*a*), 9(*b*) and 9(*c*). With reference to FIG. 8, a spring 240 is adapted to the actuator cam portion 220 and the sliding link 222 so that the sliding link 222 remains biased against the vertical surface 238.

Figure 9A:
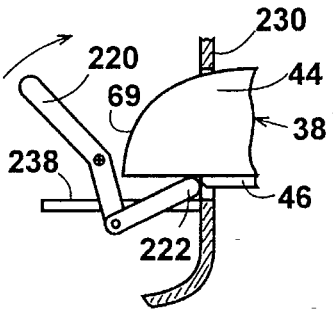
FIG. 9(*a*) is a top plan view of an actuator element of FIG. 8 disposed in proximity to the conventional latch bolt assembly wherein the spring latch bolt extends into the latch bolt receiving cavity in the extended state and the dead latch bolt is retained in the retained state within the latch bolt receiving cavity by a sliding link.
Figure 9B:
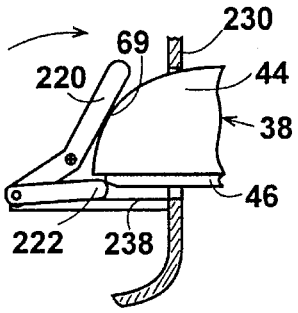
Figure 9C:
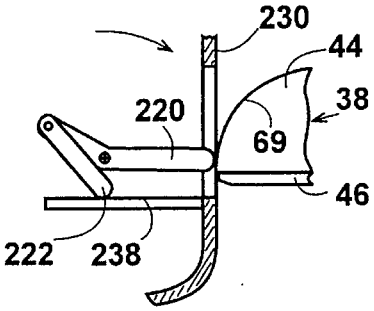

Operation of the second alternative exemplary embodiment of the door latch actuator 210 is shown in sequence in FIGS. 9(*a*), 9(*b*) and 9(*c*). In FIG. 9(*a*), the spring latch bolt 44 of the conventional latch bolt assembly 38 extends through the strike plate 230 while the sliding link 232 retains the dead latch bolt 46 in its disable state. In FIG. 9(*b*), the sliding link 222 slides along the vertical surface 238 so that the sliding link 222 first allows the dead latch bolt 46 to move from the disable state to the enable state. Once the dead latch bolt 46 is disposed in its enable state, the actuator cam portion 220 can engage the spring latch bolt 44. In FIG. 9(*b*), the actuator cam portion 220 attacks the distal end of the spring latch bolt 44 to move it from its extended state to its retracted state as shown in FIG. 9(*c*). Now, the door is caused to be in an unsecured condition at the first door position so that it can be moved from the first door position to the second door position can be advanced away from an unsecured position.

Figure 10:
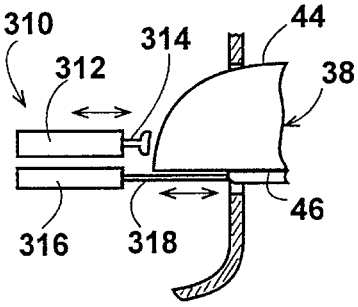
FIG. 10 is a top plan view of a third alternative exemplary embodiment of the door latch actuator of FIG. 2 which includes a pair of solenoids.

A third alternative exemplary embodiment of a door latch actuator 310 is shown in FIG. 10. The door latch actuator 310 includes first solenoid 312 with a first plunger 314 and a second solenoid 316 with a second plunger 318. In a first actuator position as shown in FIG. 10, the second plunger 318 retains the dead latch bolt 46 in its disable state. When the second solenoid 316 withdraws the second plunger 318, the dead latch bolt 46 moves to its enable state. Now, the first solenoid 312 advances the first plunger 314 to move the spring latch bolt 44 from its extended state to its retracted state. A suitable control circuit would be employed to control actuation of the solenoids with correct timing.

Figure 11:
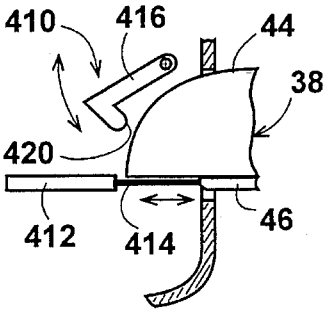
FIG. 11 is a top plan view of a fourth alternative exemplary embodiment of the door latch actuator of FIG. 2 which includes an actuator cam portion and a solenoid.

A fourth alternative exemplary embodiment of a door latch actuator 410 is shown in FIG. 11. The door latch actuator 410 includes an actuator piece 416 having an actuator cam portion 420 which moves between a first actuator position and a second actuator position by a driver which has been described in detail hereinabove. The door latch actuator 410 includes a solenoid 412 having a plunger 414. One of ordinary skill in the art would appreciate the operation of this fourth alternative exemplary embodiment of the door latch actuator 410 in that it is a combination of an actuator cam portion and a solenoid. Timed operation of the cam and solenoid would again be afforded by a suitable control circuit.

Figure 12:
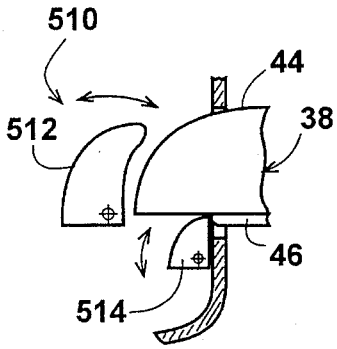
FIG. 12 is a top plan view of a fifth alternative exemplary embodiment of the door latch actuator of FIG. 2 which includes a pair of actuator cam elements.

A fifth alternative exemplary embodiment of a door latch actuator 510 is shown in FIG. 12. A pair of actuator cam elements 512 and 514 move between a first actuator position and a second actuator position by a driver or a pair of drivers which has been described hereinabove. Timing of the movement of the pair of actuator cam elements 512 and 514 of the fifth exemplary embodiment of the present invention is again critical. To move from the first actuator position to the second portion, actuator cam element 514 must first reciprocate to allow the dead latch bolt 436 to move from its disable state to its enable state before actuator cam element 512 reciprocates to move the spring latch bolt 44 from its extended state to its retracted state, just like the other embodiments of the present invention. However, to move from the second actuator position to the first actuator position, actuator cam element 514 must reciprocate first to its original location in the first actuator position before actuator cam element 512 can return to its original location in the first actuator position. Again, one of ordinary skill in the art would appreciate the operation of this fifth alternative exemplary embodiment of a door latch actuator is that it employs two separate cam elements.

It is intended that the door latch actuator of the present invention be used with a conventional trigger element 76 shown in FIG. 1. Note that controller 28 can be located anywhere between the trigger element 76 and the driver 18. One type of trigger element is a computerized card reader whereby, upon insertion of a card having a magnetic strip, the card reader determines if the card is valid. Upon validation, the card reader sends an electric signal to the door latch actuator so that the door can be opened. Another type of triggering element would be a computer device having and alpha-numeric key pad. Upon inputting the appropriate access code, this triggering element would send an electric signal to the latch actuator so that the door could be opened.

One of ordinary skill in the art would appreciate that the door latch actuator of the present invention is simple to manufacture and easy to install. Further, the door latch actuator of the present invention is generally insensitive to back pressure applied to the door. This is because any back pressure would be absorbed by the strike plate rather than upon the working components of the door latch actuator. Additionally, the door latch actuator provides a higher degree of security compared to those in the prior art by employing a strike plate. The strike plate not only protects the operating components of the door latch actuator but also prevents access thereto. Now, the door latch actuator cannot be directly forced open by a lever, a crowbar or the like. The door latch actuator device of the present invention also easily retro-fits onto existing non-secured doors to provide security therefor, without making major modifications to the doorjamb.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

I claim:

1. A door latch actuator adapted for use in association with a bolt receiver which is to be engaged by a latch bolt of a latch bolt assembly on a door that is mounted for movement between a first door position and a second door position, wherein said latch bolt has a distal end which slideably moves between an extended state and a retracted state and is operative in the extended state to engage the bolt receiver to retain the door at the first door position in a secured condition, said door latch actuator comprising:

(a) an actuator element disposed in proximity to the distal end of the latch bolt when the door is at the first door position in the secured condition, said actuator element including a cam having a first cam surface and movable between a first actuator position wherein said first cam surface operates to contact the distal end of the latch bolt and allows the distal end of the latch bolt to engage the bolt receiver in the extended state and a second actuator position wherein said actuator element displaces said latch bolt from the extended state to the retracted state causing the door to be in an unsecured condition at the first door position so that the door can be moved from the first door position to the second door position; and (b) a driver associated with said actuator element and operative to provide a reversible driving force which acts to reciprocally pivot said cam between the first and second actuator positions.

2. A door latch actuator according to claim 1 wherein said driver includes an electric motor and a gear assembly operably connected to and between said electric motor and said cam.

3. A door latch actuator according to claim 1 including a controller device operative to reversibly activate said driver whereby said cam is caused to pivot between the first and second actuator positions.

4. A door latch actuator according to claim 3 wherein said controller device includes timer circuitry operative after said cam moves from the first actuator position to the second actuator position to cause said cam to return to the first actuator position upon expiration of a selected period of time.

5. A door latch actuator mounted in a latch bolt receiving cavity in a doorjamb and operative with a latch bolt assembly on a door that is pivotally mounted in a door frame for movement between a first door position and a second door position wherein the latch bolt assembly includes a spring latch bolt and a dead latch bolt which have distal ends respectively being spring biased to extend into the latch bolt receiving cavity when the door is in the first door position, said spring latch bolt being slideably movable between an extended state and a retracted state and said dead latch bolt being slideably movable between an enable state which permits the spring latch bolt to move from the extended state to the retracted state and a disable state which prohibits the spring latch bolt from moving from the extended state to the retracted state, said door latch actuator comprising:

(a) an actuator element disposed in proximity to the distal ends of both said spring latch bolt and said dead latch bolt when the door is in the first position and movable between a first and second actuator position, said actuator element when in the first actuator position operative to retain said dead latch bolt in the disable state while allowing said spring latch bolt to extend into the latch bolt receiving cavity in the extended state thereby to retain the door at the first door position in a secured condition, said actuator element operative upon movement from the first actuator position to the second actuator position to first allow said dead latch bolt to move into the enable state and then attack the distal end of said spring latch bolt to move said spring latch bolt from the extended state to the retracted state thereby causing the door to be in an unsecured condition at the first door position so that the door can be moved from the first door position to the second door position; and (b) a driver associated with said actuator element and operative to move said actuator element between said first and second actuator positions.

6. A door latch actuator according to claim 5 wherein said actuator element includes a first actuator cam portion and a second actuator cam portion connected to said first actuator cam portion, said first actuator cam portion having a first cam surface operative to contact the distal end of said dead latch bolt when said actuator element is in the first actuator position and said second actuator cam portion having a second cam surface operative to contact said distal end of said spring latch bolt when said actuator element is in the second actuator position.

7. A door latch actuator according to claim 5 wherein said driver causes said actuator element to pivot about an axis.

8. A door latch actuator according to claim 7 wherein said driver includes an electric motor and a gear assembly operably connected to and between said electric motor and said actuator element.

9. A door latch actuator according to claim 5 including a controller device operative to reversibly activate said driver whereby said actuator element reciprocately pivots between the first and second actuator positions.

10. A door latch actuator according to claim 9 wherein said controller device includes timer circuitry operative after said actuator element pivots from the first actuator position to the second actuator position to cause said actuator element to return to the first actuator position upon expiration of a selected period of time.

11. A door latch actuator according to claim 5 including a strike plate adapted to connect to said driver and to releasably attach to the doorjamb and over the latch bolt receiving cavity, said strike plate having a port adapted for the spring latch bolt and the dead latch bolt to extend therethrough and into the latch bolt receiving cavity in the doorjamb.

12. A door latch actuator according to claim 11 including a support element adapted to attach to said strike plate and to pivotally receive said actuator element.

13. A door latch actuator according to claim 12 wherein said support element includes a stop portion adapted to restrict movement of said actuator element between the first and second actuator positions.

14. A door latch actuator according to claim 11 including a support bracket attached to said strike plate and adapted to secure said driver to said strike plate.

15. A door latch actuator mounted within a latch bolt receiving cavity in a doorjamb and operative with a latch bolt assembly on a door that is pivotally mounted in a door frame for moving the door between a first door position and a second door position wherein the latch bolt assembly includes a spring latch bolt and a dead latch bolt, both the spring latch bolt and dead latch bolt being spring biased to extend from the door and into the latch bolt receiving cavity when the door is at the first position, the spring latch bolt being slideably movable between an extended state and a retracted state and said dead latch bolt being slideably movable between an enable state which permits the spring latch bolt to move from the extended state to the retracted state and a disable state which prohibits the spring latch bolt from moving from the extended state to the retracted state, said door latch actuator comprising:

(a) a strike plate being adapted to releasably attach to the doorjamb and having a port adapted for the spring latch bolt and the dead latch bolt to extend therethrough and into the latch bolt receiving cavity in the doorjamb:

(b) an actuator element disposed in proximity to the distal ends of both said spring latch bolt and said door latch bolt and movable between first and second actuator positions, said actuator element when in the first actuator position operative to retain said dead latch bolt in the disable state while allowing said spring latch bolt to extend into the latch bolt receiving cavity in the extended state thereby to retain the door at the first door position in a secured condition, said actuator element operative upon movement from the first actuator position to the second actuator position to first allow said dead latch bolt to move into the enable state and then attack the distal end of said spring latch bolt to move said spring latch bolt from the extended state to the retracted state thereby causing the door to be in an unsecured condition at the first door position so that the door can be moved from the first door position to the second door position; and (c) a driver adapted to connect to said strike plate and operative to move said actuator element between the first and second actuator positions.

16. A door latch actuator according to claim 15 wherein said strike plate includes a pair of support prongs and a link plate, said support prongs adapted to pivotally receive said actuator element, said link plate adapted to provide a vertical surface.

17. A door latch actuator according to claim 16 wherein said actuator element is adapted to pivot between said pair of support prongs and includes an actuator cam portion pivotally connected to a sliding link wherein, upon movement from the first actuator position to the second actuator position, said sliding link operative to slide along said vertical surface to first allow said dead latch bolt to move from the disable state to the enable state so that said actuator cam portion can attack the distal end of said spring latch bolt to move said spring latch bolt from the extended state to the retracted state.

18. A door latch actuator according to claim 17 wherein said actuator element includes a spring operative to bias said sliding link against said vertical surface.

19. A door latch actuator according to claim 15 wherein said driver and said actuator element are provided by a pair of solenoids.

20. A door latch actuator according to claim 15 wherein said driver and said actuator element are provided by a motor operative to drive a cam and a solenoid.

21. A door latch actuator according to claim 15 wherein said actuator element is formed by a pair of separate actuator cam elements.

* * * * *